US009106001B2

(12) United States Patent
Hagerty et al.

(10) Patent No.: US 9,106,001 B2
(45) Date of Patent: Aug. 11, 2015

(54) CONTACT MECHANISMS FOR ELECTRICAL RECEPTACLE ASSEMBLIES

(71) Applicants: Adam Scott Hagerty, Whitesboro, NY (US); Timothy Patrick Daly, Syracuse, NY (US)

(72) Inventors: Adam Scott Hagerty, Whitesboro, NY (US); Timothy Patrick Daly, Syracuse, NY (US)

(73) Assignee: Cooper Technologies Company, Houston, TX (US)

( * ) Notice: Subject to any disclaimer, the term of this patent is extended or adjusted under 35 U.S.C. 154(b) by 99 days.

(21) Appl. No.: 14/080,574

(22) Filed: Nov. 14, 2013

(65) Prior Publication Data

US 2015/0132982 A1 May 14, 2015

(51) Int. Cl.

| | |
|---|---|
| ***H01R 13/62*** | (2006.01) |
| ***H01R 13/52*** | (2006.01) |
| ***H01R 33/97*** | (2006.01) |

(52) U.S. Cl.

CPC ..... *H01R 13/52* (2013.01); *H01R 33/971* (2013.01); *H01R 33/973* (2013.01)

(58) Field of Classification Search

CPC ..... H01R 13/52; H01R 33/971; H01R 33/973

USPC ..... 439/302, 660

See application file for complete search history.

(56) References Cited

U.S. PATENT DOCUMENTS

| | | | | |
|---|---|---|---|---|
| 6,783,382 | B2 * | 8/2004 | Felps | 439/314 |
| 7,740,499 | B1 * | 6/2010 | Willey et al. | 439/332 |
| 8,333,605 | B2 * | 12/2012 | McQuilken et al. | 439/332 |
| 8,944,837 | B2 * | 2/2015 | Huang | 439/314 |
| 8,951,051 | B2 * | 2/2015 | Natter et al. | 439/149 |

* cited by examiner

*Primary Examiner* — Khiem Nguyen

(74) *Attorney, Agent, or Firm* — King & Spalding LLP

(57) ABSTRACT

An electrical receptacle assembly having an outer body and an inner body. The inner body can include at least one first wall forming a first cavity and at least one resilient element disposed within the cavity proximate to the at least one first wall, where the at least one resilient element has an electrically conductive material. The outer body can be movably disposed within the first cavity, where the outer body can include at least one extension, at least one home slot, and at least one detent positioned between the at least one extension and the at least one home slot, where the at least one extension has the electrically conductive material, and where the at least one detent and the at least one home slot are electrically non-conductive.

20 Claims, 15 Drawing Sheets

CONTACT MECHANISMS FOR ELECTRICAL RECEPTACLE ASSEMBLIES

CROSS-REFERENCE TO RELATED APPLICATIONS

The present application is related to U.S. patent application Ser. No. 14/080,608 titled "Lockout Features For Electrical Receptacle Assemblies," which is being filed concurrently with the U.S. Patent and Trademark Office, and is hereby incorporated by reference in its entirety.

TECHNICAL FIELD

The present disclosure generally relates to electrical receptacles (also called receptacle assemblies) and, particularly, to contact mechanisms for electrical receptacle assemblies.

BACKGROUND

Electrical receptacles are used to distribute electrical power to one or more devices. Electrical receptacles also are used to provide a relatively quick disconnect of a source of power feeding the one or more devices. The electrical receptacle is configured to receive an electrical plug. When the electrical plug is mechanically coupled to the electrical receptacle, power flows through the electrical receptacle.

SUMMARY

In general, in one aspect, the disclosure relates to an electrical receptacle assembly. The electrical receptacle assembly can include an inner body having at least one first wall forming a first cavity and at least one resilient element disposed within the cavity proximate to the at least one first wall, where the at least one resilient element comprises an electrically conductive material. The electrical receptacle assembly can also include an outer body movably disposed within the first cavity, where the outer body has at least one extension, at least one home slot, and at least one detent positioned between the at least one extension and the at least one home slot, where the at least one extension has the electrically conductive material, and where the at least one detent and the at least one home slot are electrically non-conductive. The outer body can move between a first position and a second position. The at least one resilient element can contact the at least one detent when the outer body is between the first position and the second position. The at least one resilient element can contact the at least one extension when the outer body is in the second position.

These and other aspects, objects, features, and embodiments will be apparent from the following description and the appended claims.

BRIEF DESCRIPTION OF THE DRAWINGS

For a more complete understanding of the example embodiments and the advantages thereof, reference is now made to the following description, in conjunction with the accompanying figures briefly described as follows.

Figure 1A:
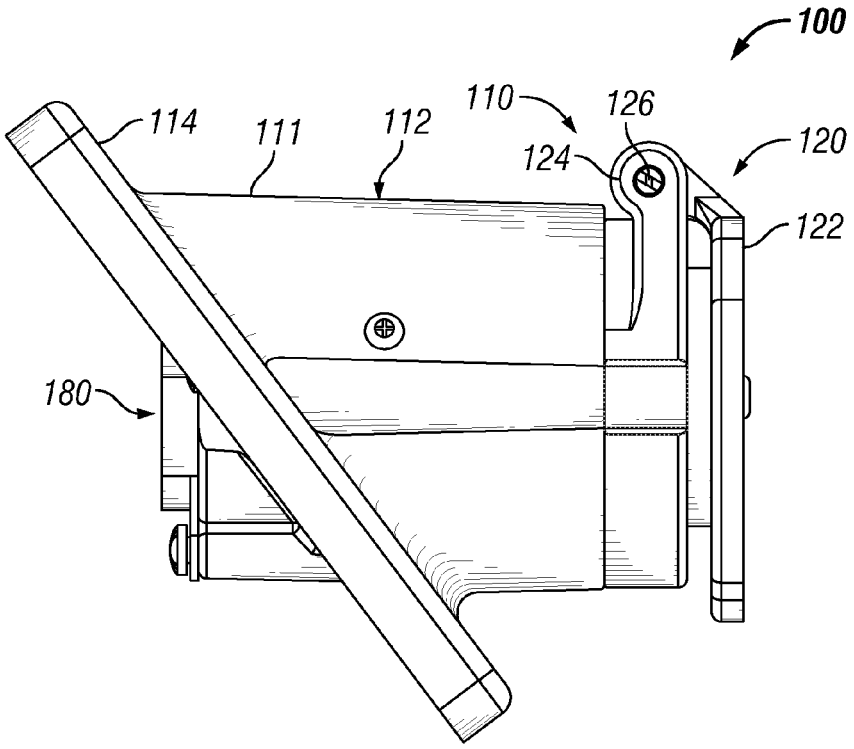
FIGS. 1A-1D show various views of an electrical receptacle in accordance with certain example embodiments.

The drawings illustrate only example embodiments and are therefore not to be considered limiting of its scope, as other equally effective embodiments are within the scope and spirit of this disclosure. The elements and features shown in the drawings are not necessarily drawn to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

The example embodiments discussed herein are directed to systems, methods, and devices for contact mechanisms for electrical receptacle assemblies. While example embodiments are directed herein to electrical receptacle assemblies for use in a potentially hazardous location, other example embodiments can be used in other types of applications. Example embodiments can be used with electrical receptacles that are located in one or more of a variety of environments, indoors or outdoors, where the electrical receptacle (also referred to herein simply as a receptacle) can be exposed. Examples of such environments can include, but are not limited to, moisture, humidity, dirt, exhaust fumes, vibrations, potential explosions, and noise.

In one or more example embodiments, the electrical receptacle can be part of an explosion-proof enclosure and/or be located in some other potentially hazardous location. An explosion-proof enclosure (also known as a flame-proof enclosure or a hazardous location enclosure) is an enclosure that is configured to contain an explosion that originates inside the enclosure. Further, the explosion-proof enclosure is configured to allow gases from inside the enclosure to escape across joints of the enclosure and cool as the gases exit the explosion-proof enclosure. The joints are also known as flame paths and exist where two surfaces meet and provide an uninterrupted path, from inside the explosion-proof enclosure toward the outside of the explosion-proof enclosure, along which one or more gases may travel. A joint may be a mating of any two or more surfaces. Each surface may be any type of surface, including but not limited to a flat surface, a threaded surface, a rabbet surface, and a serrated surface.

In one or more example embodiments, an explosion-proof enclosure is subject to meeting certain standards and/or requirements. For example, NEMA sets standards with which an enclosure must comply in order to qualify as an explosion-proof enclosure. Specifically, NEMA Type 7, Type 8, Type 9, and Type 10 enclosures set standards with which an explosion-proof enclosure within a potentially hazardous location must comply. For example, a NEMA Type 7 standard applies to enclosures constructed for indoor use in certain hazardous locations. Hazardous locations may be defined by one or more of a number of authorities, including but not limited to the National Electric Code (e.g., Class I, Division 1) and Underwriters' Laboratories, Inc. (UL) (e.g., UL 1203). For example, a Class I hazardous area under the National Electric Code is an area in which flammable gases or vapors may be present in the air in sufficient quantities to be explosive.

As a specific example, NEMA standards for an explosion-proof enclosure of a certain size (e.g., 100 $cm^3$) or range of sizes may require that in a Group B, Division 1 area, any flame path of an explosion-proof enclosure must be at least 1 inch long (continuous and without interruption), and the gap between the surfaces cannot exceed 0.0015 inches. Standards created and maintained by NEMA may be found at www.nema.org/stds and are hereby incorporated by reference.

Example embodiments can also be used with enclosures that are used in non-hazardous locations that are not required to meet the standards for an explosion-proof enclosure. For example, receptacle assemblies using example contact mechanisms can be part of a NEMA Type 3R enclosure, which can be used indoors or outdoors and can provide a degree of protection against the ingress of solid foreign objects (e.g., dirt, dust), ingress of water (e.g., rain sleet, snow), and formation of ice on the enclosure.

The example receptacle assemblies (or components thereof) described herein can be made of one or more of a number of suitable materials to allow the receptacle assemblies to meet certain standards and/or regulations while also maintaining durability in light of the one or more conditions under which the receptacle assemblies can be exposed. Examples of such materials can include, but are not limited to, aluminum, stainless steel, fiberglass, glass, plastic, and rubber.

Example embodiments described herein can be used with electrical receptacles rated for one or more of a number of voltages and/or amperes. For example, an electrical receptacle using example embodiments can be rated for 20 amperes (A) and 250 volts (V). Therefore, example embodiments of contact mechanisms for electrical receptacle assemblies described herein should not be considered limited to a particular voltage and/or amperage rating.

A user may be any person that interacts with an electrical receptacle using example embodiments described herein. Specifically, a user may install, maintain, operate, and/or interface with an electrical receptacle using example contact mechanisms. Examples of a user may include, but are not limited to, an engineer, an electrician, an instrumentation and controls technician, a mechanic, an operator, a consultant, a contractor, and a manufacturer's representative.

Example embodiments of example contact mechanisms for electrical receptacle assemblies will be described more fully hereinafter with reference to the accompanying drawings, in which example contact mechanisms for electrical receptacle assemblies are shown. Contact mechanisms may, however, be embodied in many different forms and should not be construed as limited to the example embodiments set forth herein. Rather, these example embodiments are provided so that this disclosure will be thorough and complete, and will fully convey the scope of contact mechanisms for electrical receptacle assemblies to those or ordinary skill in the art.

Like, but not necessarily the same, elements (also sometimes called components) in the various figures are denoted by like reference numerals for consistency. Terms such as "first," "second," "distal," "lower," "top," "middle," "bottom," "front," and "back" are used merely to distinguish one component (or part of a component) from another. Such terms are not meant to denote a preference or a particular orientation. Further, the use of the terms inner body and outer body are merely meant to describe an orientation of these components relative to their proximity to the body of an enclosure to which an example electrical receptacle is attached. Specifically, the inner body can be physically closer to the body of the electrical enclosure than the outer body.

Further, for any figures described below, labels not shown in such figures but referred to with respect to such figures can be incorporated by reference from one or more figures previously described herein. Similarly, a description of a label shown in certain but not described with respect to such figures can use the description from figures previously described herein.

Figure 1B:
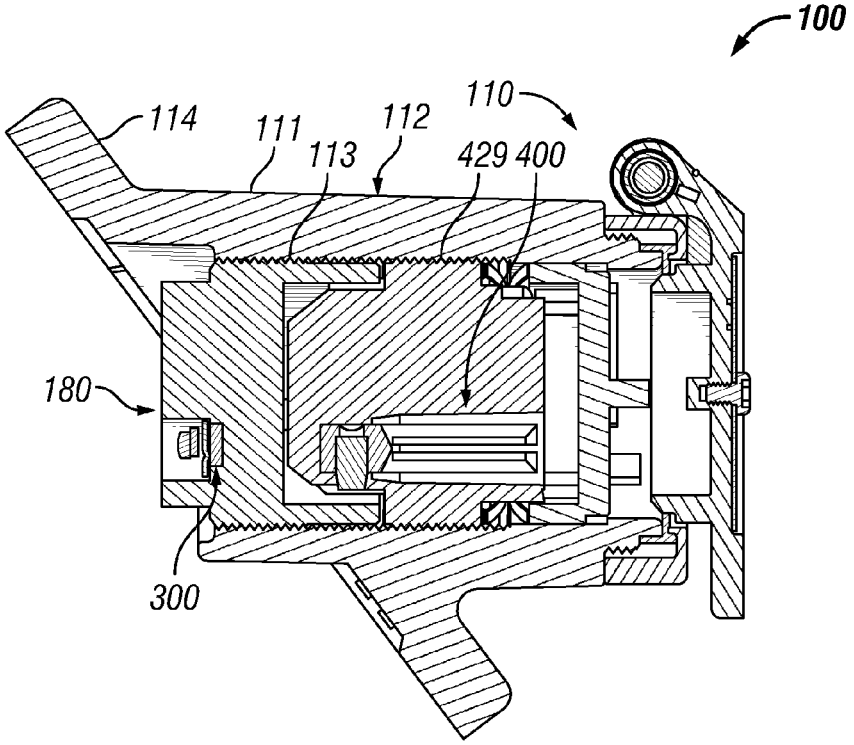
Figure 1C:
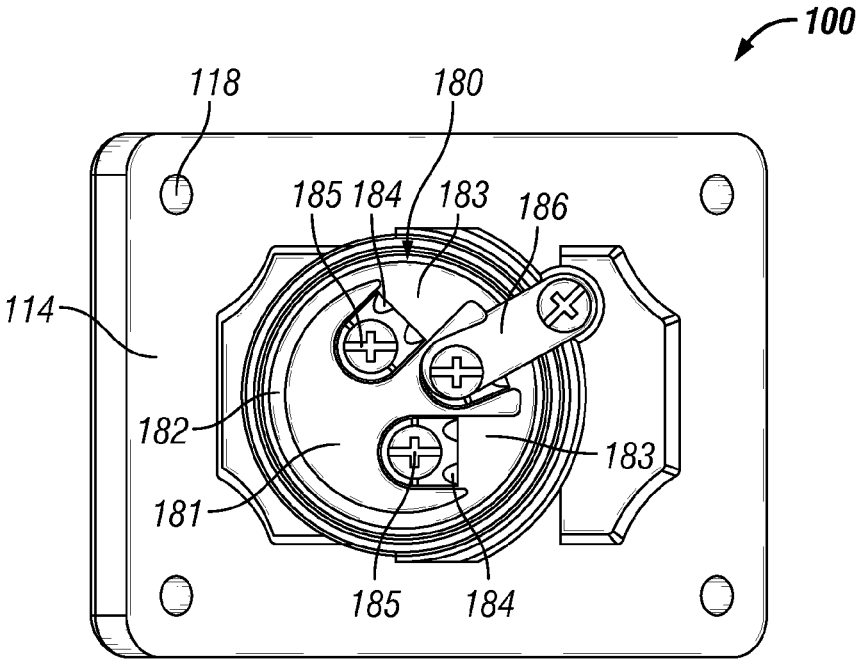
Figure 1D:
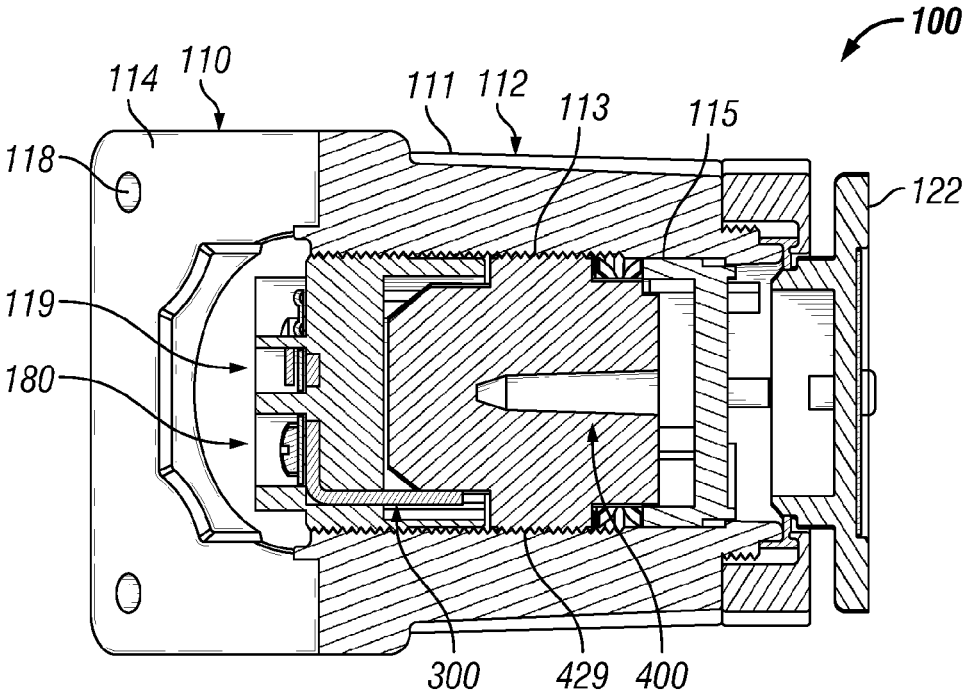

FIGS. 1A-1D show various views of an electrical receptacle 100 in accordance with certain example embodiments. Specifically, FIG. 1A shows a side view of the electrical receptacle 100. FIG. 1B shows a cross-sectional side view of the electrical receptacle 100. FIG. 1C shows a bottom view of the electrical receptacle 100. FIG. 1D shows a cross-sectional top view of the electrical receptacle 100. In one or more example embodiments, one or more of the components shown in FIGS. 1A-1D may be omitted, repeated, and/or substituted. Accordingly, example embodiments of an electrical receptacle (or portions thereof) should not be considered limited to the specific arrangements of components shown in FIGS. 1A-1D.

Referring now to FIGS. 1A-1D, the electrical receptacle 100 can include the housing 110 and a lower body 180. The housing 110 can include a cover assembly 120. The housing 110 can also include a base portion 114 that is configured to mechanically couple to a body of an enclosure (e.g., a junction box, an explosion-proof enclosure, a motor control center). The base portion 114 can include one or more coupling features 118 (in this case, apertures) that are configured to couple to corresponding coupling features of the body on the enclosure. The coupling features 118 of the base portion 114 can include, but are not limited to, apertures, slots, clips, clamps, and tabs. The base portion 114 can mechanically couple to the body of an enclosure using one or more of a number of coupling methods, including but not limited to fastening devices (e.g., bolts), welding, compression fittings, and bracketing.

The housing 110 can also include at least one wall 112 that extends from the base portion 114 at some angle. The wall 112 can have an inner surface 113 and an outer surface 111. The wall 112 can form a cavity 119, defined by the inner surface 113 of the wall 111, into which one or more components (e.g., the inner body 180, the outer body 400) of the electrical receptacle 100 can be disposed. The cavity 119 can be formed by multiple adjacent inner surfaces (e.g., inner surface 113, inner surface 115) of the wall 112. The cavity 119 can traverse the base portion 114 of the housing 110. Also shown in FIGS. 1B and 1D is the outer body 400 disposed within the cavity 119. Specifically, a portion of the outer body 400 is shown mechanically coupled to inner surface 113 of the wall 112. The inner surface 113 of the wall 112 and/or the outer surface 429 of the outer body 400 can have one or more coupling features that allow the outer body 400 to mechanically couple to the inner surface 113 of the wall 112. In addition, such coupling features may allow for movement (e.g., rotational) of the outer body 400 within the cavity 119 formed by the wall 112 of the housing 110.

Examples of such coupling features disposed on the inner surface 113 can include, but are not limited to, mating threads, slots, tabs, detents, and clips. In the example shown in FIGS.

1B and 1D, mating threads are disposed along the inner surface 113 of the wall 112, while complementary mating threads are disposed on the outer surface 429 of the outer body 400. The mating threads allow the outer body 400 to move (e.g., rotate) within the cavity 119 formed by the wall 112. If the electrical receptacle 100 is coupled to the body of an explosion-proof enclosure, then the junction between the outer surface 429 of the outer body 400 and the inner surface 113 of the wall 112 of the housing 110 can form a flame path.

The cover assembly 120 of the housing 110 can be used to protect and provide access to one or more portions (e.g., a faceplate 510, as described below with respect to FIGS. 5A-5D) of the electrical receptacle 110. The cover assembly 120 can include a base 122, and a hinge pin 126 disposed in an end section 124 of the base 122 to allow the base 122 to hingedly rotate relative to the wall 112.

At least a portion of the inner body 180, which is described in more detail below with respect to FIGS. 2A-2E, can protrude through the base portion 114 while a remainder of the inner body 180 is disposed in the aperture 119. The bottom of the inner body 180 can have a raised section 181 that extends upward from a bottom surface 182. The raised section 181 can have one or more channels 183 that allow for one or more terminal clamps 184 to be disposed therein and mechanically coupled to the bottom surface 182 using one or more of a number of fastening devices 185. The fastening devices 185 can be adjusted inward and outward from the bottom surface 182 so that an electric conductor (not shown) can be positioned between the terminal clamp 184 and the bottom surface 182. When the electric conductor is so positioned, the fastening device 185 can be lowered toward the bottom surface 182, creating a secure mechanical coupling between the terminal clamp 184 and the electric conductor. The fastening device 185 can be any of a number of types of fastening devices, including but not limited to a screw (as shown), a bolt, a clamp, a slot, and a tab.

In some cases, as for a ground connection, a ground strap 186 is used instead of an electric conductor. In such a case, the terminal clamp 184 can be removed. When one end of the ground strap 186 is mechanically coupled to the bottom surface 182 by a fastening device 185, the other end of the ground strap 186 can be mechanically coupled to a portion of the housing 110 using another fastening device 185. Such a portion of the housing 110, as well as the fastening devices 185, can be made of an electrically conductive material.

Figure 2A:
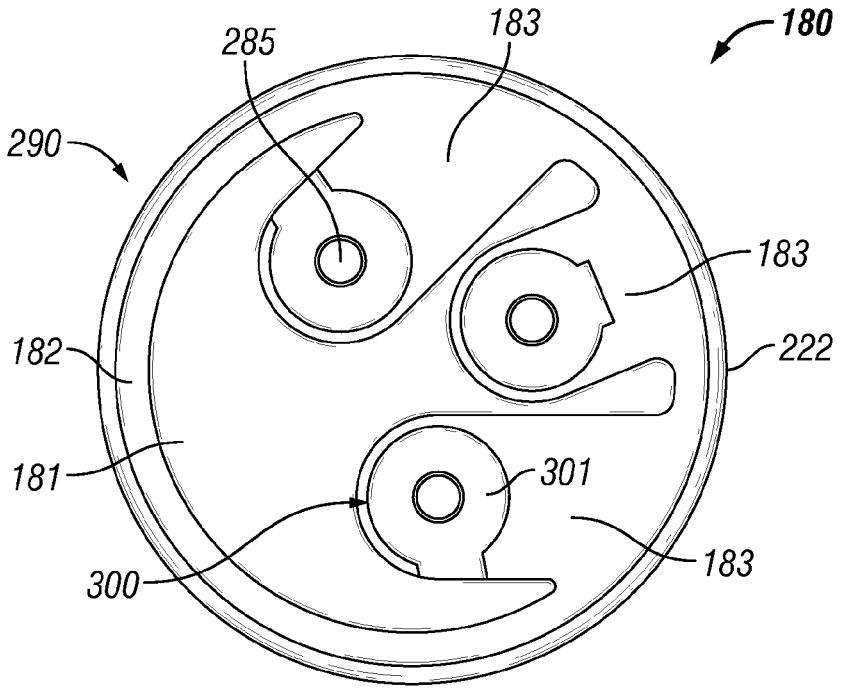
FIGS. 2A-2E show various views of an inner body of the electrical receptacle of FIGS. 1A-1D in accordance with certain example embodiments.
Figure 2B:
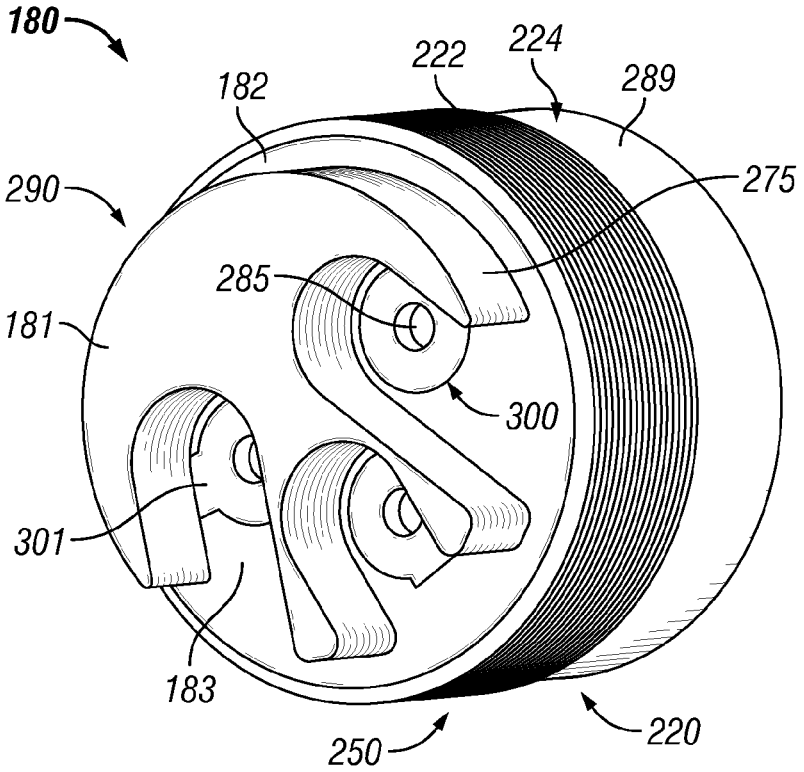
Figure 2C:
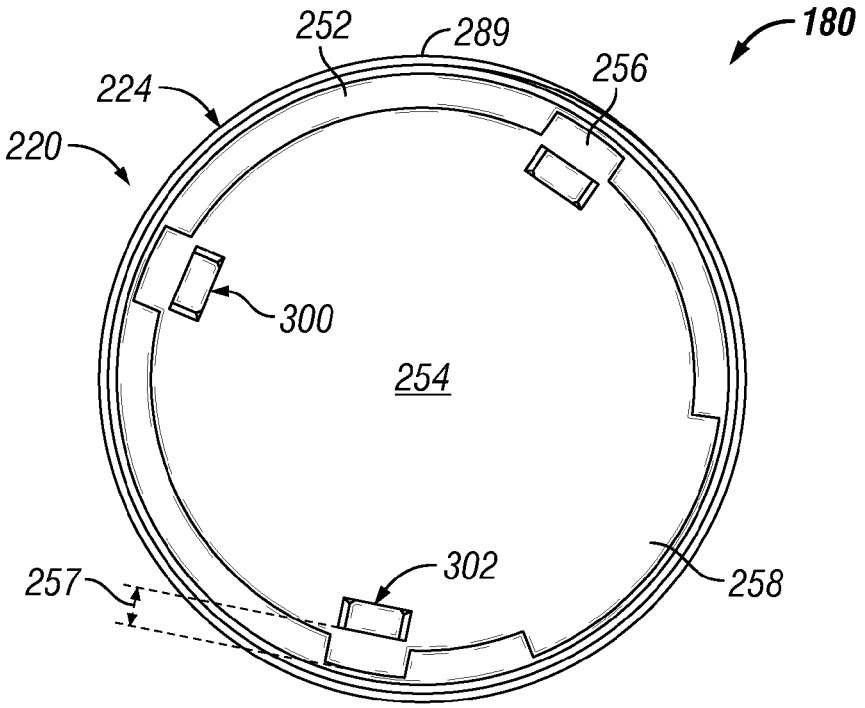
Figure 2D:
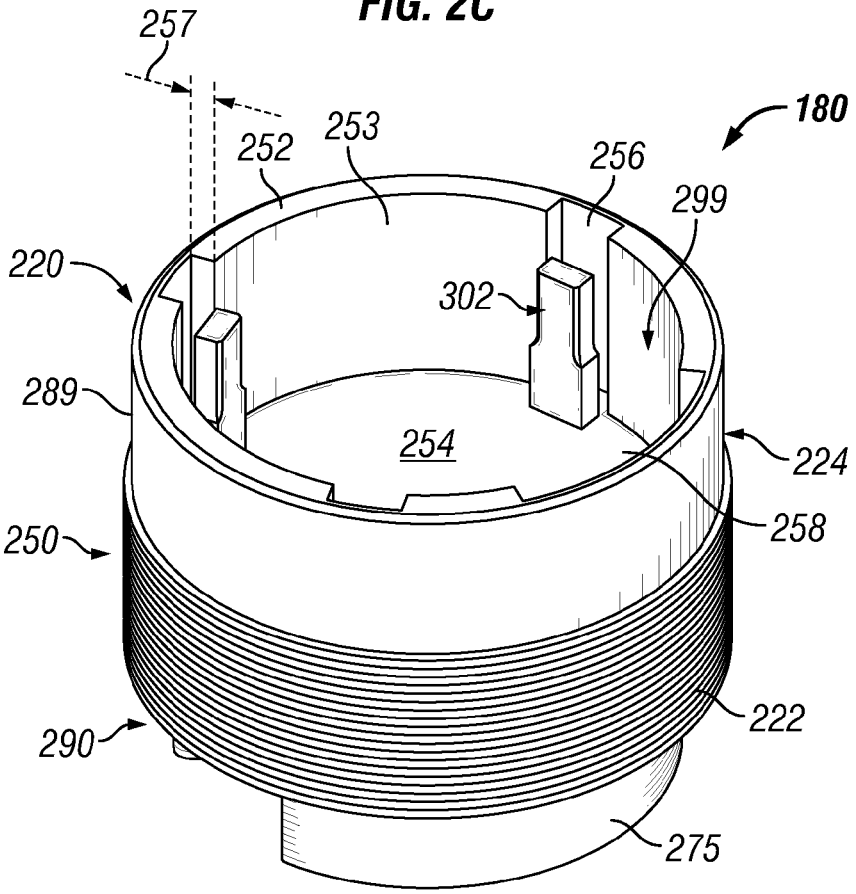
Figure 2E:
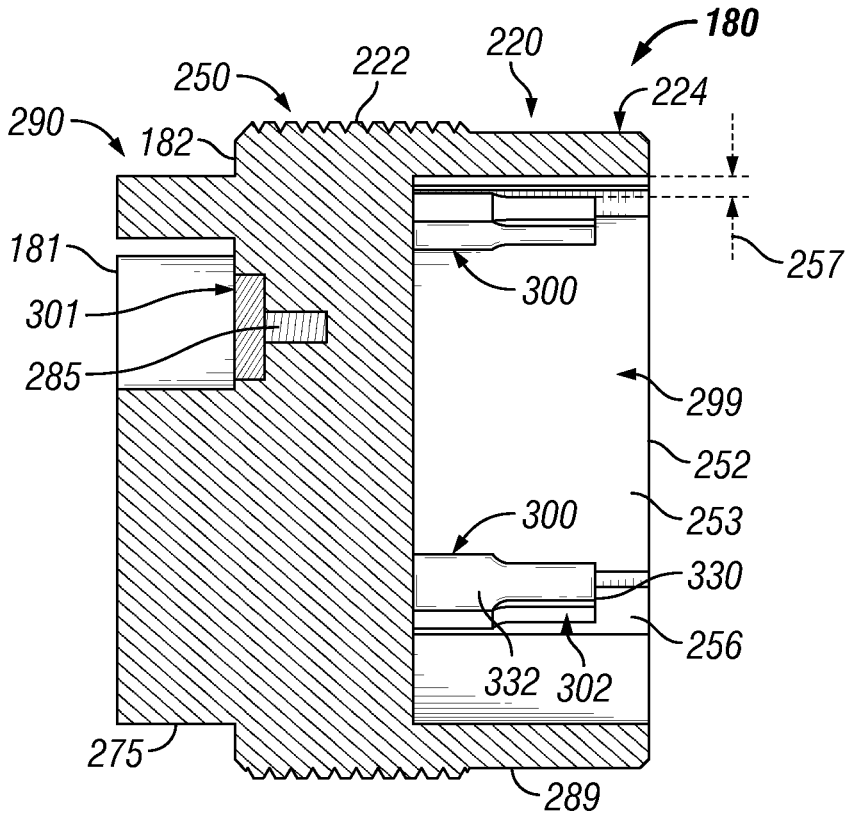

FIGS. 2A-2E show various views of the inner body 180 of the electrical receptacle 100 of FIGS. 1A-1D in accordance with certain example embodiments. Specifically, FIG. 2A shows a bottom view of the inner body 180. FIG. 2B shows a bottom-side perspective view of the inner body 180. FIG. 2C shows a top view of the inner body 180. FIG. 2D shows a bottom-side perspective view of the inner body 180. FIG. 2E shows a cross-sectional side view of the inner body 180. In one or more example embodiments, one or more of the components shown in FIGS. 2A-2E may be omitted, repeated, and/or substituted. Accordingly, example embodiments of an inner body (or portions thereof) should not be considered limited to the specific arrangements of components shown in FIGS. 2A-2E.

Referring to FIGS. 1A-2E, the inner body 180 can have multiple sections. For example, as shown in FIGS. 2A-2E, the inner body 180 can have a top section 220, a middle section 250, and a bottom section 290. The bottom section 290, shown in detail in FIGS. 2A and 2B, can include the bottom surface 182, the raised section 181, and one or more channels 183. With the fastening devices 185 and the terminal clamps 184 removed, an end portion 301 of a number of resilient elements 300 is shown disposed on the bottom surface 181. These resilient elements 300 are described in more detail below with respect to FIGS. 3A-3C. In certain example embodiments, the resilient elements 300 are overmolded into the inner body 180. Alternatively, the resilient elements 300 can be pressed or otherwise assembled into the inner body 180. For example, the end 301 of the resilient element 300 can be mechanically coupled to the bottom surface 182 of the inner body 180 using a fastening device 185. The resilient elements 300 can be considered a separate component of, or a part of, the inner body 180.

The end portion 301 of the resilient elements 300 can be substantially flush with the bottom surface 182. Alternatively, the end portion 301 of the resilient elements 300 can be raised from, or sunken within, the bottom surface 182. The raised section 181 can have a side wall 275 that has a height. The height of the wall 275 (and, thus, the height of the raised portion 181 relative to the bottom surface 182) can be greater than the combined height of the end portion 301 of a resilient element 300 (or, more accurately, the portion of the end portion 301 that protrudes above the bottom surface 182), an electric conductor, a terminal clamp 184, and a fastening device 185. In such a case, all of these components are disposed within a channel 183 and are protected within the walls 275 of the raised section 181.

The middle section 250 of the inner body 180 can have one or more of a number of recesses (hidden from view) that each has a shape and/or size that is substantially similar to the shape and/or size of an end portion 301 of the resilient element 300. In addition, other portions of the resilient element 300 can be disposed in one or more apertures (hidden from view) that traverse the middle section. In such a case, the end 301 of the resilient element 300 that is opposite the end portion 301 can be exposed in the top section 220.

The middle section 250 can also have an outer surface 222 that has disposed thereon one or more of a number of coupling features. Examples of such coupling features disposed on the outer surface 222 can include, but are not limited to, mating threads (as shown), slots, tabs, detents, and clips. In certain example embodiments, the coupling features disposed on the outer surface 222 of the middle section 250 of the inner body 180 can complement the coupling features disposed on the inner surface 113 of the wall 112 of the housing 110, inside of which the inner body 180 is disposed.

Once positioned inside the cavity 119 of the housing 110, the inner body 180 may remain stationary. In such a case, the coupling features disposed on the outer surface 222 of the inner body 180, the coupling features disposed on the inner surface 113 of the wall 112 of the housing 110, and/or some other feature (e.g., a weld, a fastening device) can be used to ensure that the inner body 180 maintains a stationary position within the cavity 119.

In certain example embodiments, the middle section 250 also includes one or more fastener receivers 285 that traverse at least some of the middle section 250. The fastener receivers 285 are configured to receive and couple to the fastening devices 185. In such a case, the fastening device 185, as well as components (e.g., a resilient element 300, a terminal clamp 184) of the electrical receptacle 100 disposed between the fastening device 185 and the bottom surface 182 of the bottom section 290 of the inner body 180, can be mechanically coupled to the inner body 180.

The top section 220 of the inner body 180 can have at least one wall 224 and a bottom wall 254 that forms a cavity 299. The wall 224 can have an inner surface 253, an outer surface 289, and a top surface 252. In certain example embodiments, the at least one wall 224 has one or more features that are disposed along its inner surface 253. For example, as shown in FIGS. 2A-2E, the inner surface 253 can include one or more (in this case, three) of a number of recesses 256. Such recesses can be disposed on the inner surface 253 adjacent to the end 302 of a resilient element 300. In such a case, the end 302 of the resilient element 300 can be a distance 257 from the adjacent recess 256.

The width of the recess 256 can be larger than a width of the end 302 of the resilient member. Thus, the end 302 of the resilient member 300 can be pushed outward toward the recess 256 with a displacement less than the distance 257 without touching the wall of the recess 256. The number of recesses 256 can be at least as great as the number of resilient elements 300. The positioning of the of the recesses 256 can correspond to the positioning of the resilient elements 300, so that each resilient element 300 is adjacent to a recess 256. Each recess can be disposed along some or all of the height of the top section 220 of the inner body 180. In any case, a recess 256 is disposed in the inner surface 253 of the wall 224 starting at or near the top of the wall 224.

Another example of a feature that can be disposed along the inner surface 253 of the at least one wall 224 of the top section 220 of the inner body 180 is one or more larger recesses 258. As shown in FIGS. 2A-2E, the recess 258 can be larger (wider) than any of recesses 256. Recess 258 can be located adjacent to one or two recesses 256. The depth and thickness of recess 258 can be the same or different than the depth and/or thickness of recess 256. Unless noted otherwise, the various components of the inner body 180 can be made of one or more of a number of electrically non-conductive materials.

Figure 3A:
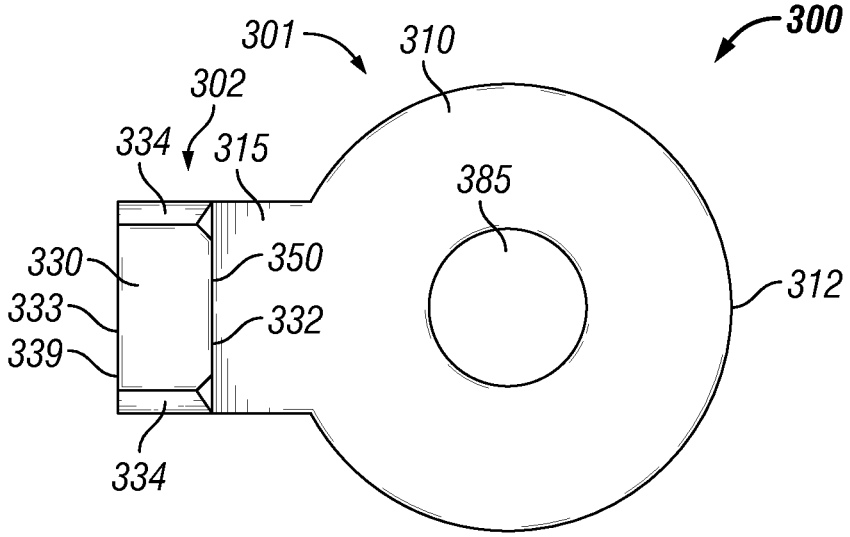
FIGS. 3A-3C show various views of a resilient element shown in FIGS. 2A-2E in accordance with certain example embodiments.
Figure 3B:
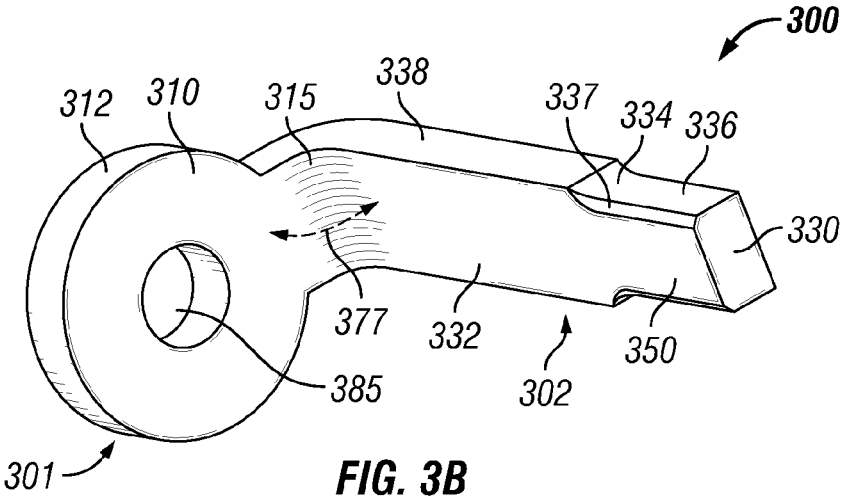
Figure 3C:
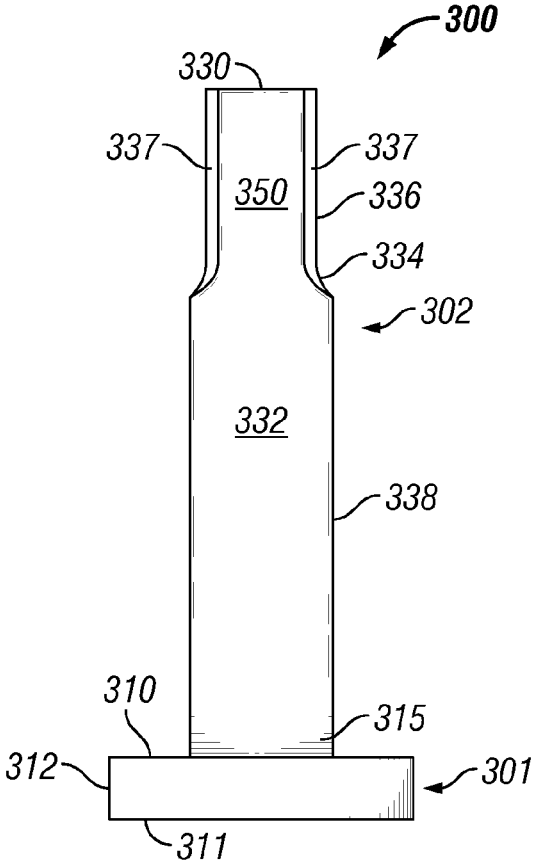

FIGS. 3A-3C show various views of the resilient element 300 shown in FIGS. 2A-2E in accordance with certain example embodiments. Specifically, FIG. 3A shows a top view of the resilient element 300. FIG. 3B shows a perspective view of the resilient element 300. FIG. 3C shows a front view of the resilient element 300. In one or more example embodiments, one or more of the components shown in FIGS. 3A-3C may be omitted, repeated, and/or substituted. Accordingly, example embodiments of a resilient element (or portions thereof) should not be considered limited to the specific arrangements of components shown in FIGS. 3A-3C.

Referring to FIGS. 1A-3C, the resilient element 300 (sometimes known by other terms, such a leaf spring) is made of an electrically conductive material. As stated above, the resilient element 300 has a first end 302 and a second end 301. The end 301 and the end 302 can be substantially perpendicular to each other. In other words, the angle 377 between the end 301 and the end 302 can be substantially 90° under normal conditions (e.g., when no lateral force is applied to the front surface 332 and/or the front surface 350 of the end 302).

The end 301 and the end 302 of the resilient element 300 can be joined by a curved section 315. The curved section 315, the end 301, and the end 302 can be made of a single piece (as from a mold). Alternatively, curved section 315, the end 301, and/or the end 302 can be multiple pieces that are mechanically coupled to each other using one or more of a number of coupling methods, including but not limited to welding, compression fittings, and fastening devices.

In certain example embodiments, the curved section 315 and/or the elongated length of the end 302 provides an amount of flexibility that allows the end 302 to be displaced backward, making the angle 377 between the end 301 and the end 302 greater than 90°. In such a case, the relative stiffness of the end 302 and/or the curved section 315 can provide resilience, so that when the lateral force is no longer applied to the end 302, the end 302 returns to its normal position (i.e., the angle 377 returns to approximately 90°) relative to the end 301.

In certain example embodiments, the end 301 has an aperture 385 that traverses therethrough. Such aperture 385 can have a size large enough for receiving a fastening device 185. The end 301 can have any of a number of shapes. For example, as shown in this example, the end 301 has a substantially circular shaped when viewed cross-sectionally from the top. Other shapes can include, but are not limited to, a square, a hexagon, and an octagon. The shape and/or size of the end 301 can be substantially the same as the shape and/or size of recess in the bottom surface 182 of the bottom section 290 of the inner body 180.

The end 301 can have a depth that is the height of the side 312 of the end 301. Further, the top surface 301 and the bottom surface 311 of the end 301 can have a width (measured from the outer perimeter of the aperture 385 to the side 312). The depth and width of the end 301 can be sufficient to secure solid mechanical and electrical contact with an electrical conductor, a terminal clamp 184, and/or a ground strap 186. The depth and width of the end 301 can also be sufficient to retain the resiliency of the resilient element 300 from lateral forces applied to the end 302 while the end 301 maintains mechanical and electrical contact with an electrical conductor, a terminal clamp 184, and/or a ground strap 186.

In certain example embodiments, some other fastening and/or coupling feature, in addition to or in place of the aperture 385, can be used to mechanically and electrically couple the end 301 to an electric conductor or a ground strap 186. For example, a slot, a tab, or a clamp can be used in lieu of an aperture 385 and fastening device 185 to mechanically and electrically couple the end 301 to an electric conductor or a ground strap 186.

The end 302 of the resilient element 300 can be an elongated segment having one or more of a number of features. The elongated segment forming the end 302 can have one or more of a number of shapes. For example, in this case, the end 302 is formed by a larger rectangular section adjacent to the curved section 315, followed by a smaller substantially rectangular section. The lower (and larger) rectangular section can have a front surface 332, a pair of side surfaces 338, and a back surface 333. The corners where these surfaces meet can be substantially squared, similar to the corners of the end 301.

The upper section of the end 302 has a front surface 350, two side surfaces 336, and a back surface 339. While the corners formed by the back surface 339 and the two side surfaces 336 can be substantially similar to the corners formed in the lower section of the end 302, the corners 337 formed by the front surface 350 and the two side surfaces 336 can be beveled. These beveled corners 337 can be used to help the end 302 interact with various portions of the outer body 400, as described below with respect to FIGS. 4A-4D. The corners between the top 330 and the front surface 350, the side surfaces 336, and the back surface 339 can be beveled or substantially the same as the corners of the end 301. A transition piece 334 can be disposed between each side surface 336 and each side surface 338.

The end 302 can have a depth that is the height of the side 338, which is slightly greater than the height of the side 336 (because of the beveled corner 337) of the end 302. Further, the front surface 332 and the back surface 333 of the lower section of the end 302 can have a width that is greater than the width of the front surface 350 and the back surface 339 of the upper section of the end 302. Similarly, the curved section 315 can have a width (substantially the same as the width of the front surface 332) and a depth (substantially the same as, or ranging between, the depth of the side 312 and/or the depth of the side surface 338.

The depths and widths of the end 302, as well as the curved section 315, can be sufficient to secure solid mechanical and electrical contact between the front surface 350 and an extension 475 of the outer body 400, as described below with respect to FIGS. 4A-4D. The depths and widths of the end 302 and the curved section 315 can also be sufficient to retain the resiliency of the resilient element 300 from lateral forces applied to the end 302 while the end 301 maintains mechanical and electrical contact with an electrical conductor, a terminal clamp 184, and/or a ground strap 186. While many of the surfaces (e.g., the front surface 350, beveled corners 337, front surface 332) of the resilient element 300 are shown to be substantially flat and smooth, such surfaces can, additionally or in the alternative, have one or more of a number of other features, including but not limited to curvature (e.g., concave, convex), serrations, and texture.

Figure 4A:
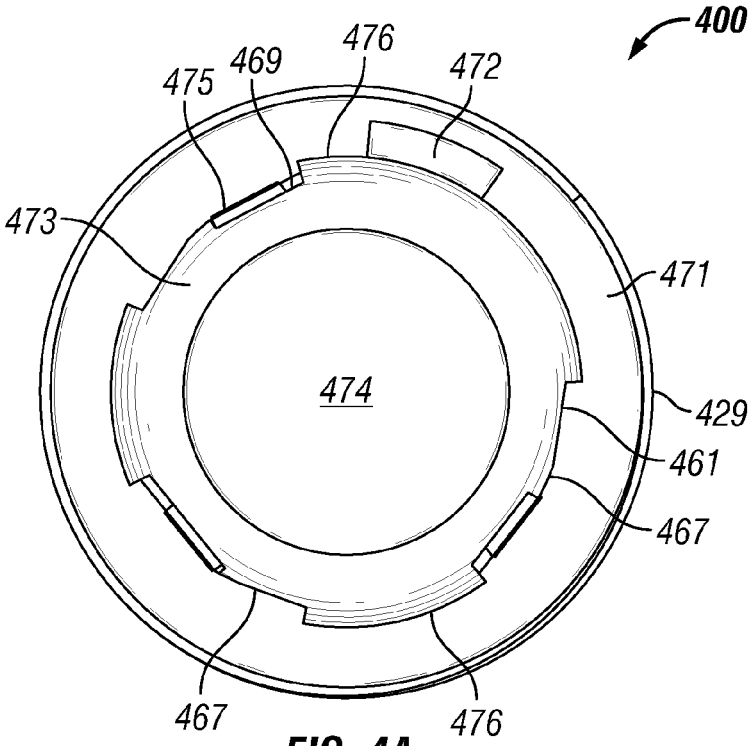
FIGS. 4A-4D show various views of an outer body of the electrical receptacle of FIGS. 1A-1D in accordance with certain example embodiments.
Figure 4B:
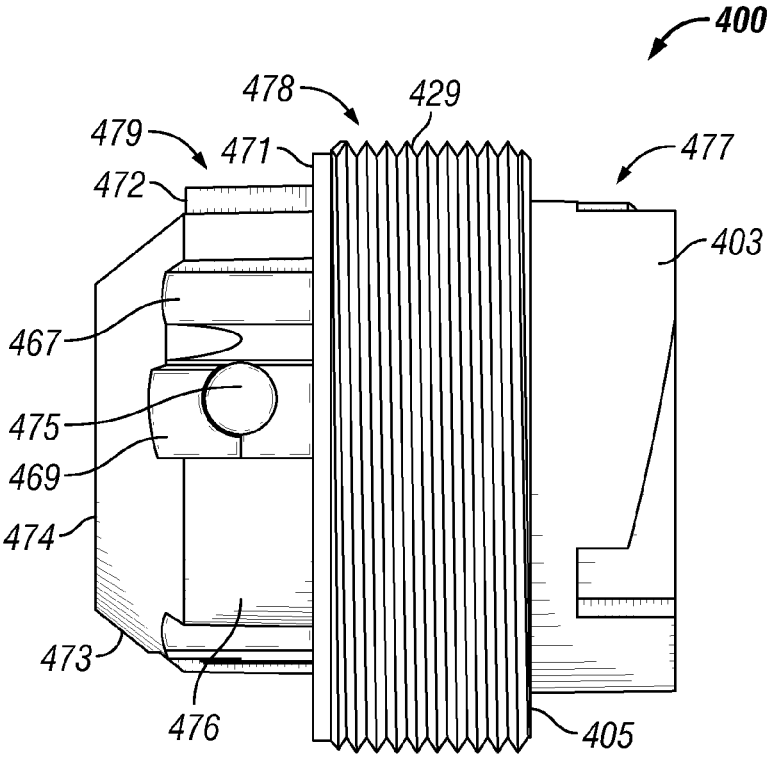
Figure 4C:
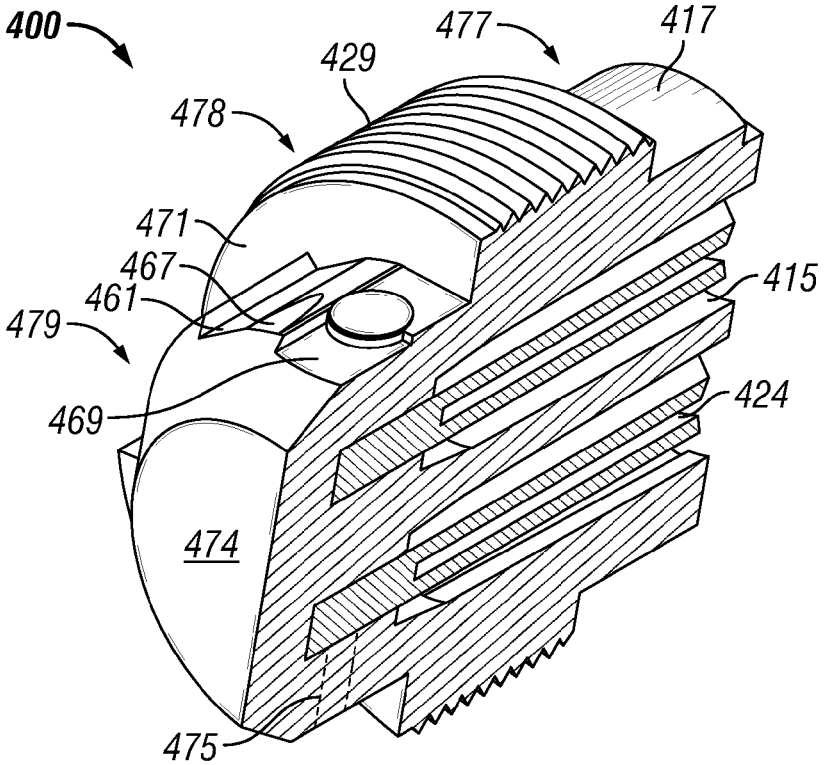
Figure 4D:
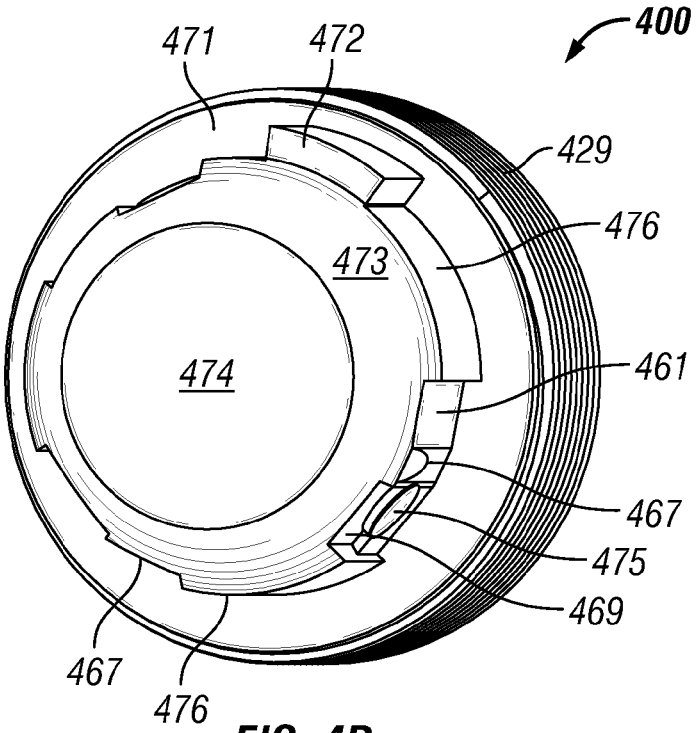

FIGS. 4A-4D show various views of the outer body 400 of the electrical receptacle 100 of FIGS. 1A-1D in accordance with certain example embodiments. FIG. 4A shows a bottom view of the outer body 400. FIG. 4B shows a side view of the outer body 400. FIG. 4C shows a cross-sectional side perspective view of the outer body 400. FIG. 4D shows a bottom perspective view of the outer body 400. In one or more example embodiments, one or more of the components shown in FIGS. 4A-4D may be omitted, repeated, and/or substituted. Accordingly, example embodiments of an outer body (or portions thereof) should not be considered limited to the specific arrangements of components shown in FIGS. 4A-4D.

Referring to FIGS. 1A-4D, the outer body 400 can have one or more of a number of different portions. For example, as shown in FIG. 4B, the outer body 400 can have a top portion 477, a middle portion 478, and a bottom portion 479. In this example, all portions are concentric, with the top portion 477 and the bottom portion 479 having substantially the same outer perimeter, which is slightly smaller than the outer perimeter of the middle portion 478. The gap formed between the bottom portion 479 and the middle portion 478 forms a shelf 471. Similarly, the gap formed between the outer surface 403 of the upper portion 477 and the outer surface 429 of the middle portion 478 forms a shelf 405.

Inside of the outer body 400 can be positioned one or more pin assemblies 424. Each pin assembly 224 can be part of a terminal receiver. In such a case, the terminal receiver can also include an aperture (not shown) disposed in the top surface of the outer body 400. Each pin assembly 424 can traverse some or all of the height of the outer body 400. The pin assembly 424 can be made of an electrically conductive material so that electricity can flow therethrough and/or so that an electrical ground connection can be secured. The electrically conductive material of the pin assembly 424 can be the same or different than the electrically conductive material of the resilient element 300, the terminal clamp 184, the ground strap 186, and/or any other component of the electrical receptacle 100 made of an electrically conductive material.

The pin assembly 424 can have one or more of a number of configurations. The purpose of each pin assembly 424 is to receive a terminal from an electrical plug and provide substantial mechanical contact with the terminal so that the electrical coupling between the pin assembly 424 and the terminal of the plug is consistent and not subject arcing, faults, or other adverse conditions that can lead to a disruption in the flow of electricity between the terminal of the plug and the pin assembly 424.

Each pin assembly 424 can be configured in one or more of a number of ways. In this case, the pin assembly 424 is circular with four quadrants that are divided by two breaks that run along the diameter through the center and are perpendicular to each other. When a terminal from an electrical plug is inserted into the pin assembly 424, the pin assembly 424 can expand while applying a sufficient inward force toward the terminal, thus maintaining solid mechanical contact with the terminal, which leads to solid and consistent electrical contact between the terminal and the pin assembly 424. The electrical plug carries electrical power, which is transferred through the terminals of the electrical plug to the pin assemblies 424 when the terminals of the electrical plug are mechanically coupled to the pin assemblies 424.

In certain example embodiments, an extension 475 is attached to the bottom end of the pin assembly 424. The extension 475 can be made of an electrically conductive material, which can be the same or different than the material of the pin assembly 424. The extension 475 can be used to contact another electrically conductive element (in this case, the front surface 350 of the resilient element 300) positioned adjacent to the bottom portion 479 of the outer body 400 when the outer body 400 is rotated into a certain position. In such a case, the distal end of the extension 475 protrudes through, or is accessible at, an aperture disposed at the bottom portion 479 of the outer body 400. Thus, when electrical power received from an electrical plug flows through the pin assemblies 424, the flow of electrical power continues through the extensions 475.

The extension 475 can form a single piece (as from a mold) with the pin assembly 424. Alternatively, the extension 475 can be a separate piece that is mechanically coupled to the pin assembly 424 using one or more of a number of coupling methods, including but not limited to welding, fastening devices, and compression fittings. The pin assemblies 424 can traverse the top portion 477, the middle portion 478, and at least a portion of the bottom portion 479. The extensions 475 can be disposed in the bottom portion 479.

The pin assemblies 424 and the extensions 475 can be encased in sleeves 415. Each sleeve 415 can be made of an electrically non-conductive material. Each sleeve can directly abut against, or be adjacent to (have a gap between), a pin assembly 424 and/or an extension 475. Each sleeve 415 can be of sufficient thickness as to prevent the risk of arcing between adjacent pin assemblies 424 and/or extensions 475 when the pin assemblies 424 and extensions 475 are energized (have electricity flowing through them).

In certain example embodiments, the middle portion 778 has an outer surface 429 on which one or more of a number of coupling features (in this case, mating threads) are disposed. Thus, using the coupling features on the outer surface 429, the middle portion 778 (and, thus, the outer body 400) can be mechanically coupled to the inner surface 113 of the wall 112. The coupling features disposed on the outer surface 429 of the middle portion 778 and on the inner surface 113 of the wall 112 can allow the outer body 400 to move (e.g., rotate) within the cavity 119 of the housing 110. Specifically, the outer body 400 can move between an "off" position (electricity does not flow through the electrically conductive components of the electrical receptacle 100) and an "on" position (electricity flows through the electrically conductive components of the electrical receptacle 100).

In certain example embodiments, the bottom portion 479 is where the extensions 475 are exposed, which allows the extensions 475 to make mechanical contact with another electrical conductor (e.g., the front surface 350 of the resilient element 300) when the outer body 400 is positioned a certain way within the cavity 119 of the housing 110. Specifically, the extensions 475 can protrude through one or more apertures (hidden from view) in the side wall 469 of the bottom portion 479. In such a case, the ends of the extensions are exposed.

In addition to the extensions 475, the bottom portion 479 can include one or more of a number of other features. For example, the bottom portion 479 can include at least one detent 467 located on the side wall 476 adjacent to an extension 475 on one side of the detent 467 and to a home slot 461 on the other side of the detent 467. Each detent 467 is positioned relative to the adjacent extension 475 in such a way that the front surface 350 of a resilient element 300 contacts the detent 467 when the outer body 400 is between the "on" position and the "off" position. The front surface 350 of a resilient element 300 contacts the home slot 461 when the outer body 400 is in the "off" position, and the front surface 350 of a resilient element 300 contacts the extension 475 when the outer body 400 is in the "on" position.

The shape and size of the detents 467 provide a level of resistance when the outer body 400 is in the "off" position (i.e., when the front surface 350 of a resilient element 300 contacts the home slot 461) that prevents the outer body 400 from rotating relative to the inner body 180. Similarly, the shape and size of the detents 467 (in this case, the outer edge of the detent, positioned adjacent to the extension 475) provide a level of resistance when the outer body 400 is in the "on" position (i.e., when the front surface 350 of a resilient element 300 contacts the extension 475) that prevents the outer body 400 from rotating relative to the inner body 180. Finally, the shape and size of the detents 467 provide a level of resistance when the outer body 400 is moving between the "off" position and the "on" position (i.e., when the front surface 350 of a resilient element 300 contacts the detent 467) that prevents the outer body 400 from moving (e.g., rotating) relative to the inner body 180 without additional force (in this case, rotational force) applied to the outer body 400.

The level of resistance provided by the detents 467 can be large enough to prevent an inadvertent change of position of the outer body 400. For example, the detents 467 can provide enough resistance against the resilient elements 300 to prevent the outer body 400 from moving out of the "on" position when vibrations are present. However, a large enough rotational force applied to the outer body 400 can overcome the resistance provided by the detents 467 against the resilient elements 300. For example, when an electrical plug is inserted into the pin assemblies 424 and applies a rotational force in the proper direction, the outer body 400 can change position.

Another feature of the bottom portion 479 of the outer body 400 is at least one protrusion 472 that extends outward from the side wall 476. The protrusion 472 can be disposed on the side wall 476 adjacent to a home slot 461, a detent 467, and/or an extension 475. The protrusion 472 can have a width that is less than the width of the recess 258 of the inner body 180. In such a case, the protrusion 472 can be positioned within the recess 258 of the inner body 180. Since the inner body 180 remains stationary when the outer body 400 moves (e.g., rotates), the recess 258 of the inner body 180 can limit of the movement of the protrusion 472, which in turn limits the movement of the outer body 400.

The positioning and orientation of the detents 467, protrusion 472, and side walls 469 through which the extensions 475 are disposed can be arranged to correspond to the positioning and orientation of the recess 258 and the ends 302 of the resilient elements 300 so that the ends 302 of the resilient elements 300 contact the detents 467 when the protrusion 472 is positioned at one end of the recess 258 (corresponding with the outer body 400 being in the "off" position), and so that the ends 302 of the resilient elements 300 contact the extensions 475 when the protrusion 472 is positioned at the other end of the recess 258 (corresponding with the outer body 400 being in the "on" position).

Other features of the bottom portion 479 of the outer body 400 can include, but are not limited to, a bottom surface 474 and a transition piece 473 that is disposed between the bottom surface 474 and the top end of one or more other features (e.g., the side wall 469, the detents 467) of the bottom portion 479. In such a case, the bottom surface 474 can have a smaller footprint (outer perimeter), so that the transition piece 473 forms a non-perpendicular angle with the bottom surface 474. Unless noted otherwise, the various components of the outer body 400 can be made of one or more of a number of electrically non-conductive materials.

Figure 5B:
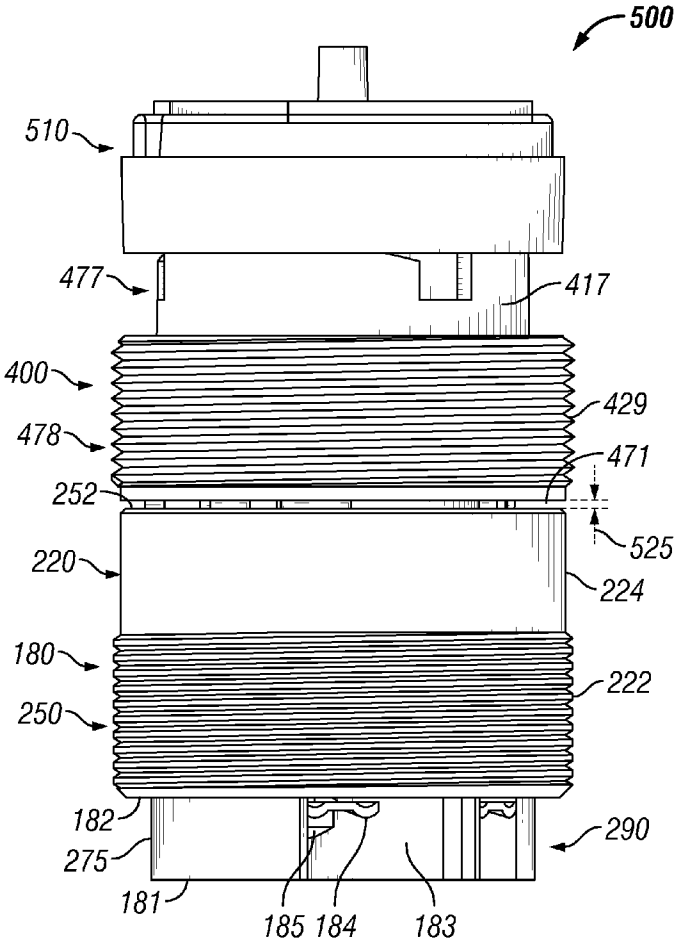
FIG. 5A-5D show various views of a subassembly of the electrical receptacle of FIGS. 1A-1D in accordance with certain example embodiments.
Figure 5A:
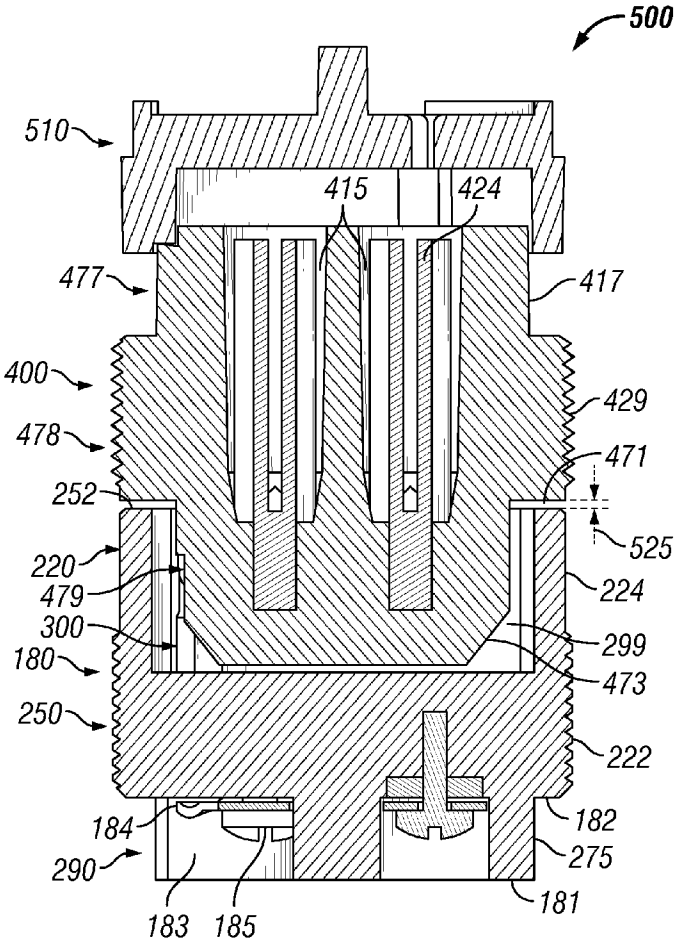
Figure 5D:
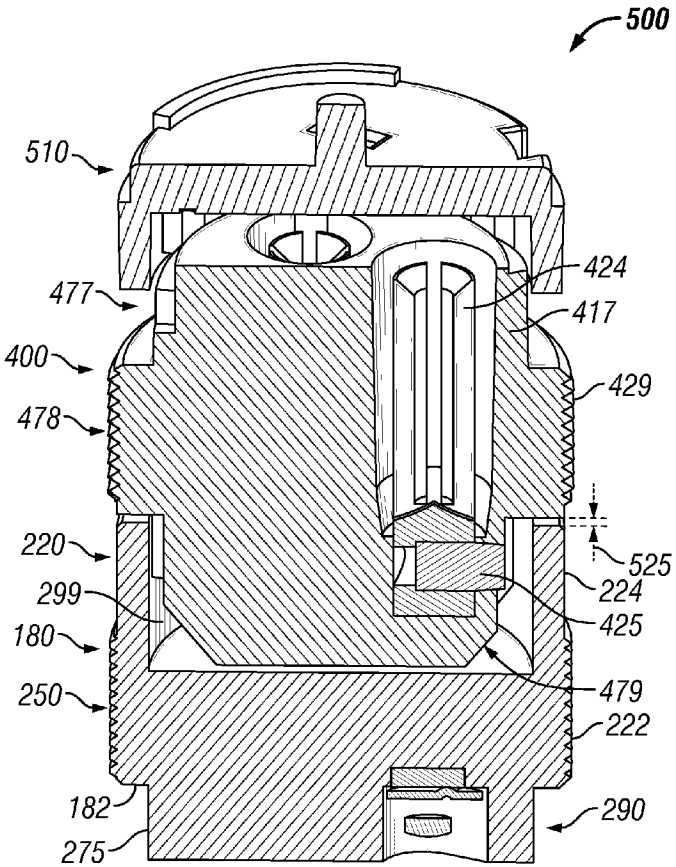
Figure 5C:
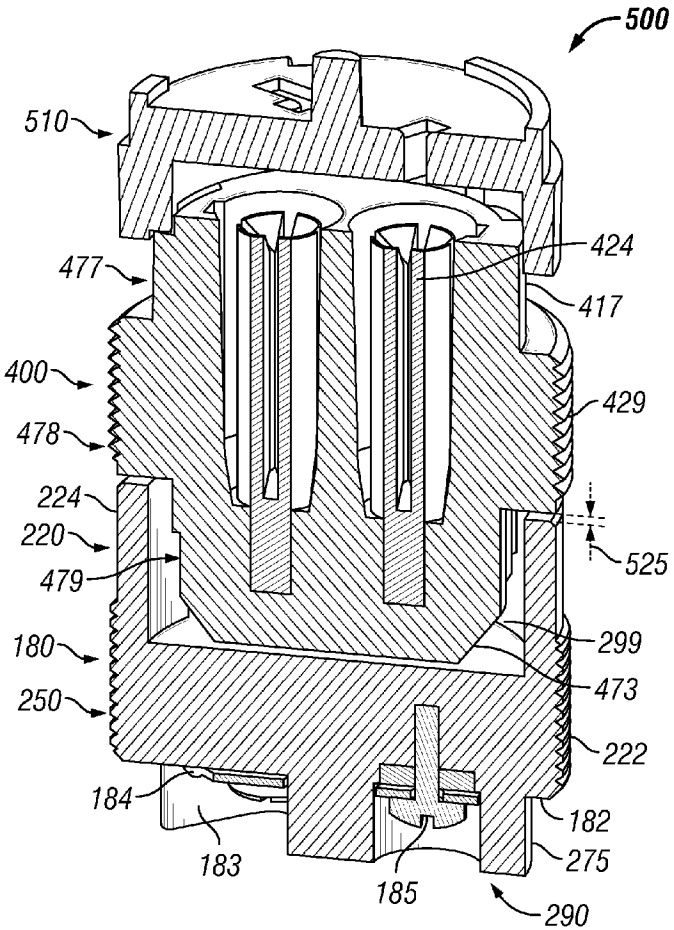
Figure 6A:
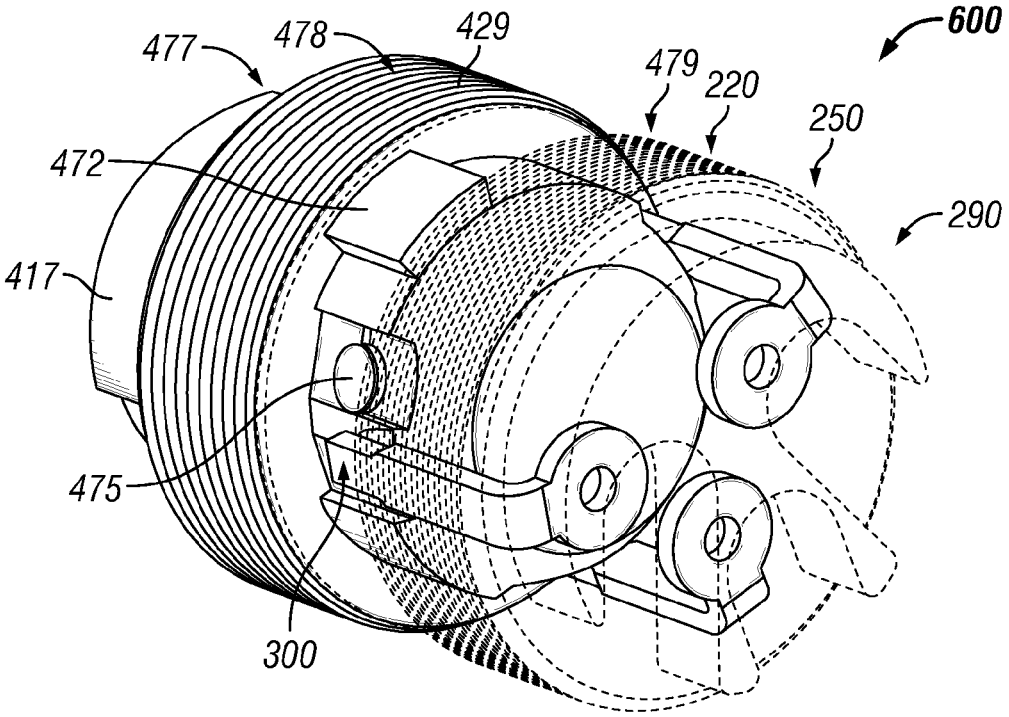
FIGS. 6A-6D show various views of the inner body and the outer body in accordance with certain example embodiments.
Figure 6B:
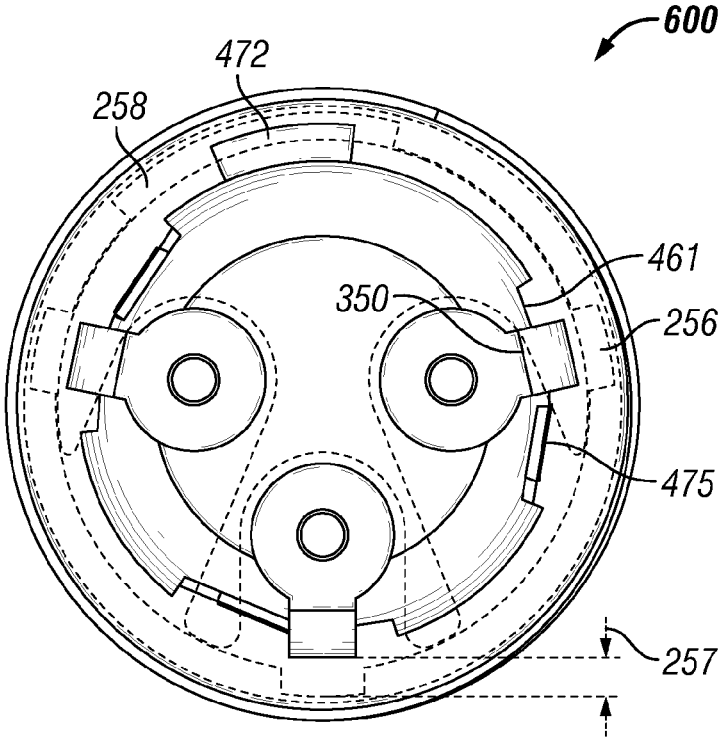
Figure 6C:
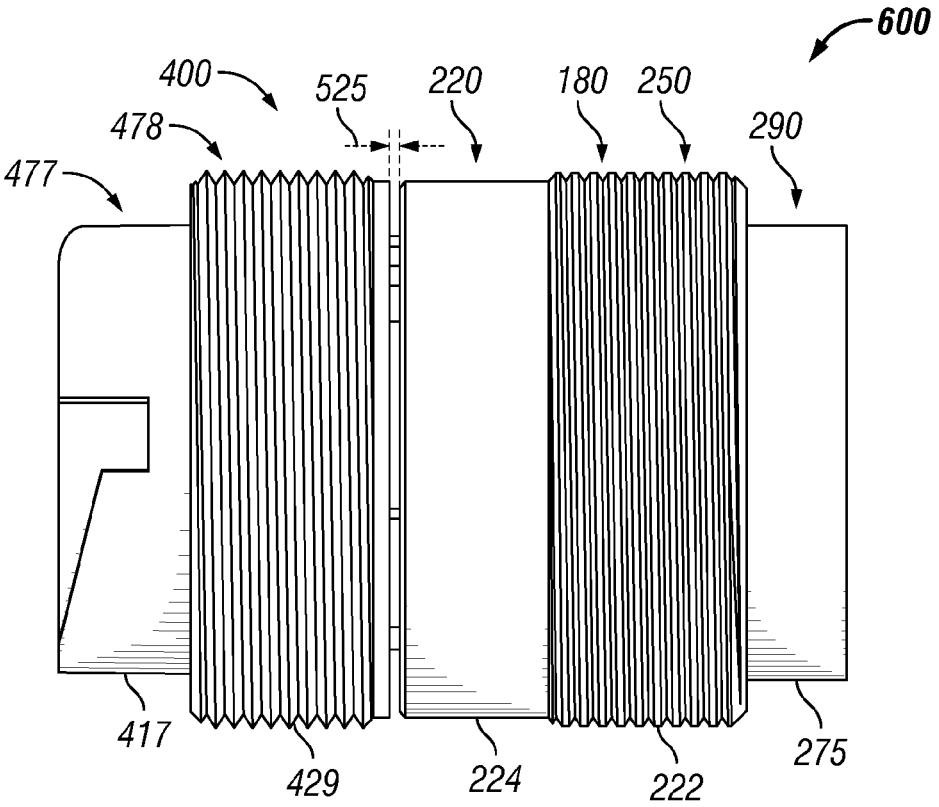
Figure 6D:
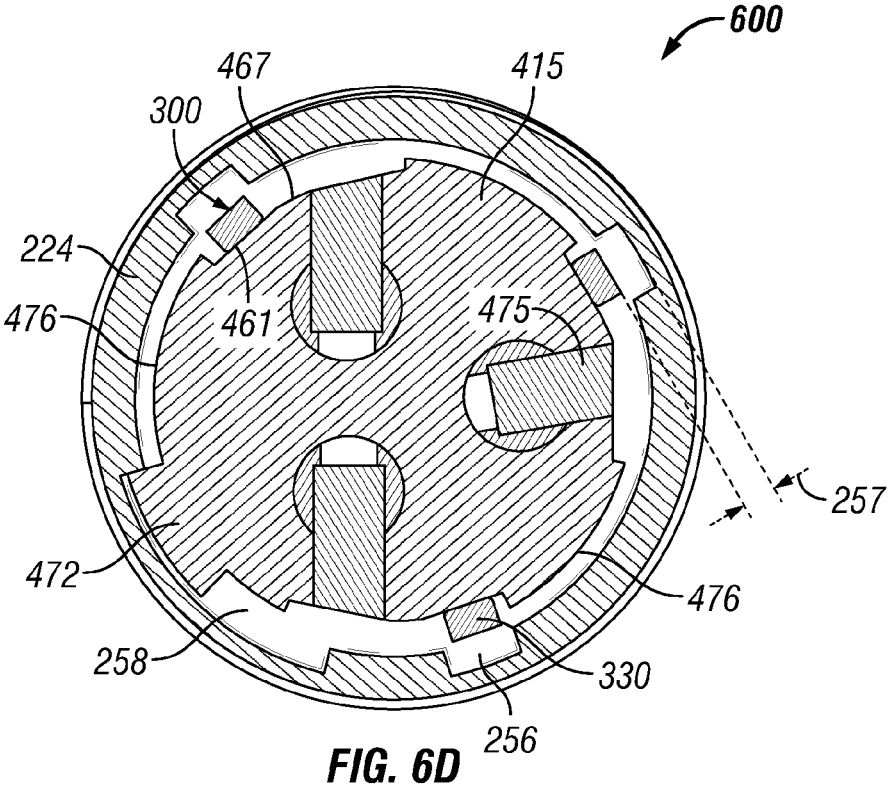

FIG. 5A-5D show various views of a subassembly 500 of the electrical receptacle of FIGS. 1A-1D in accordance with certain example embodiments. FIG. 5A shows a cross-sectional side view of the subassembly 500. FIG. 5B shows a side view of the subassembly 500. FIGS. 5C and 5D each shows a cross-sectional side perspective view of the subassembly 500. In one or more example embodiments, one or more of the components shown in FIGS. 5A-5D may be omitted, repeated, and/or substituted. Accordingly, example embodiments of a subassembly of an electrical receptacle (or portions thereof) should not be considered limited to the specific arrangements of components shown in FIGS. 5A-5D.

The subassembly 500 in this case includes the inner body 180, the outer body 400, and a faceplate 510. Referring to FIGS. 1A-5D, the interaction of the components of the top section 220 of the inner body 180 and the bottom portion 479 of the outer body 400 can be seen more clearly. In FIGS. 5A-5D, the outer body 400 is in the "off" position, which means that the ends 302 of the resilient elements 300 contact the detents 467 of the bottom portion 479 of the outer body 400 rather than the extensions 475.

When the inner body 180 and the outer body 400 are positioned within the cavity 119 of the housing 110, the cavity 299 formed by the at least one wall 224 and the bottom wall 254 of the top portion 220 of the inner body 180 is enclosed (or substantially enclosed) by the bottom portion 479 of the outer body 400. In this example, because the outer body 400 rotates along mating threads between the "off" position and the "on" position, there is some vertical displacement in the position of the outer body 400 relative to the inner body 180, which remains stationary as the outer body 400 moves between the "off" position and the "on" position.

Figure 7B:
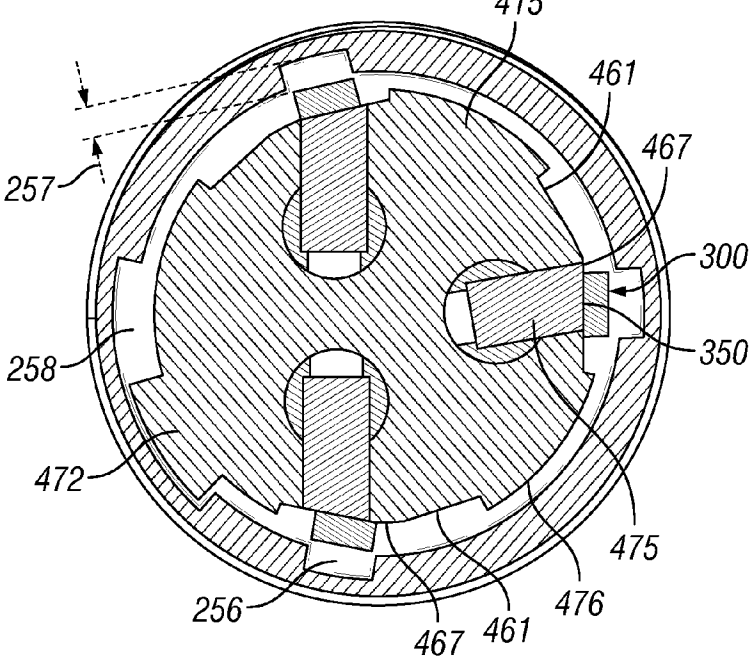
FIGS. 7A and 7B show various views of the inner body and the outer body in accordance with certain example embodiments.
Figure 7A:
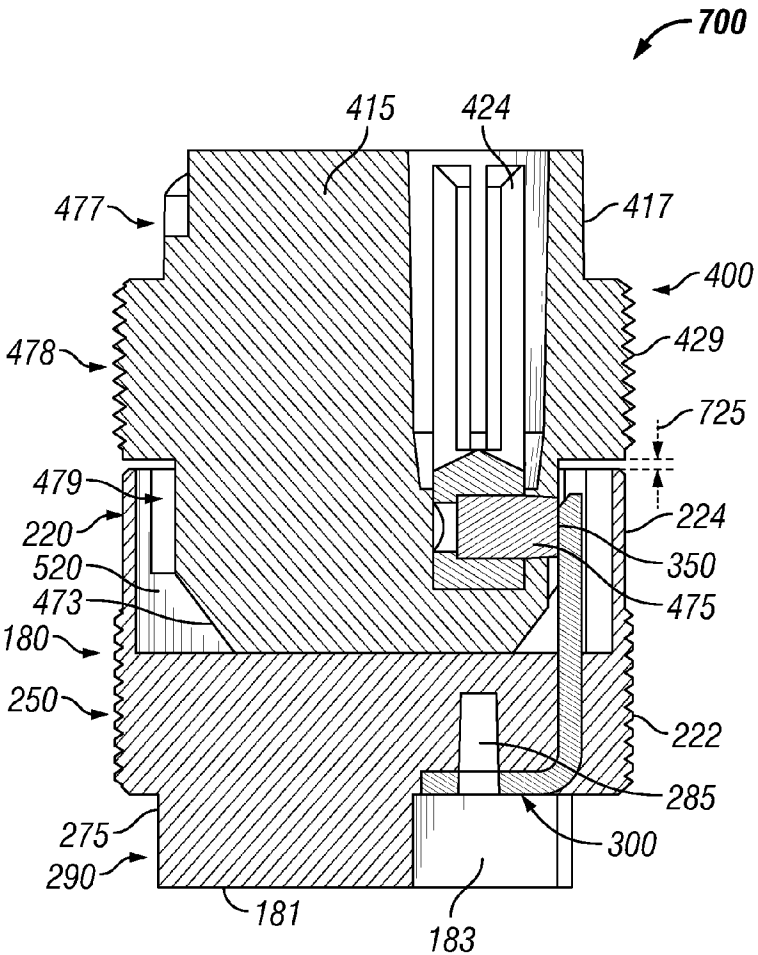

Thus, in this example, if the outer body 400 is in the "off" position, there is a gap 525 between the shelf 471 of the outer body 400 and the top surface 252 of the wall 224 of the inner body 180. As shown in FIGS. 7A and 7B below, when the outer body 400 in this example rotates from the "off" position to the "on" position, the gap between the shelf 471 of the outer body 400 and the top surface 252 of the wall 224 of the inner body 180 can decrease. When the example electrical receptacle 100 is coupled to the body of an enclosure that is used for certain applications, such as potentially hazardous environments, the top portion 220 of the inner body 180 and the bottom portion 479 of the outer body 400 can form its own explosion-proof enclosure, forming cavity 299.

In certain example embodiments, the outer body 400 is mechanically coupled to the faceplate 150. As shown in FIG. 1D, located above the inner surface 113 of the housing 110 is inner surface 115. In certain example embodiments, inner surface 115 is smooth and has no features disposed thereon. The inner surface 115 can have a size and/or shape to receive at least a portion of the faceplate 150. In such a case, the faceplate 150 can freely rotate horizontally and also have limited vertical movement within the cavity 119. The outer perimeter of the inner surface 115 can be substantially the same as, or different than, the outer perimeter of the inner surface 113.

In certain example embodiments, the faceplate 150 acts as an interface between the terminals of an electrical plug and the pin assemblies 424 of the outer body 400. The faceplate 150 can have one or more of a number of features and/or configurations. An example of a faceplate 150 can be found in the U.S. patent application titled "Lockout Features For Electrical Receptacle Assemblies," as referenced and incorporated by reference above with respect to the first paragraph of this specification.

FIGS. 6A-7B show various positions of the inner body 180 relative to the outer body 400 using example embodiments. FIGS. 6A-6D show the outer body 400 in the "off" position 600 relative to the inner body 180 in accordance with certain example embodiments. FIGS. 7A and 7B show various views of the outer body 400 in the "on" position 700 relative to the inner body 180 in accordance with certain example embodiments.

Referring to FIGS. 1A-7B, when the outer body 400 is in the "off" position 900, the end 302 of the resilient elements 300 are in contact with the detents 467 of the bottom portion 479 of the outer body 400. Put another way, the end 302 of the resilient elements 300 are not in contact with the extensions 475 of the outer body 400. As a result, with the lack of mechanical coupling between the resilient elements 300 and the extensions 475, electric power does not flow through the electrical receptacle 100.

In addition, as stated above, the gap 525 between the shelf 471 of the outer body 400 and the top surface 252 of the wall 224 of the inner body 180 exists. If the electrical receptacle 100 is used in a hazardous environment, then the enclosure formed by the top portion 220 of the inner body 180 and the bottom portion 479 of the outer body 400 can be considered an explosion-proof enclosure. In such a case, the gap 525 (in this case, a flame path) may be too large. However, because there is no electric path between the resilient elements 300 and the extensions 475 within the cavity 299, the distance of the gap 525 as a flame path may not be relevant.

As the outer body 400 is rotated from the "off" position 600 to the "on" position 700, the detents 467 can apply an outward force to the ends 302 of the resilient elements 300. As a result, the distance 257 between the end 302 of the resilient element 300 and the adjacent recess 256 can decrease until the detents 467 no longer contact the front surface 350 of the resilient elements 300. When this occurs, the outer body 400 is in the "on" position 700, and the front surface 350 of the end 302 of the resilient elements 300 contact the extensions 475. In other words, because the resilient elements 300 are resilient, the distance 257 between the end 302 of the resilient element 300 and the adjacent recess 256 is restored when the detents 467 stop applying an outward force to the front surfaces 350 of the resilient elements 300.

Further, when the outer body 400 moves into the "on" position 700, a smaller gap 725 results between the shelf 471 of the outer body 400 and the top surface 252 of the wall 224 of the inner body 180. The gap 725 is smaller than the gap 525 that exists when the outer body 400 is in the "off" position 600. When the outer body 400 is in the "on" position 700, the resilient elements 300 contact the extensions 475. As a result, electrical power flows through the resilient elements 300 and the extensions 475 within the cavity 299. In such a case, when the electrical receptacle 100 is used in a hazardous environment, the gap 725 can be a flame path. In certain example embodiments, the outer body 400 and the inner body 180 are configured and oriented in such a way that the gap 725 formed when the outer body 400 is in the "on" position 700 meets one or more standards and/or regulations for the flame path of an explosion-proof enclosure.

Figure 8:
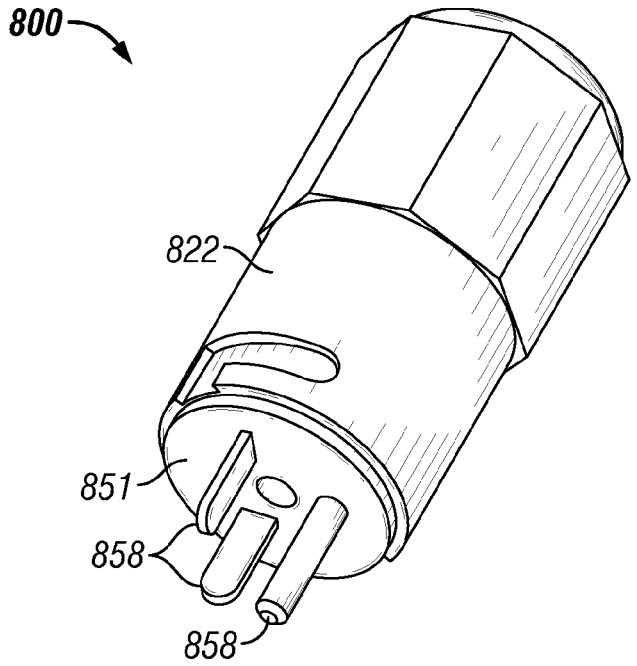
FIG. 8 shows a perspective view of a plug in accordance with certain example embodiments.

FIG. 8 shows a perspective view of an electrical plug 800 in accordance with certain example embodiments. In one or more example embodiments, one or more of the components shown in FIG. 8 may be omitted, repeated, and/or substituted. Accordingly, example embodiments of an electrical plug (or portions thereof) should not be considered limited to the specific arrangements of components shown in FIG. 8.

Referring to FIGS. 1A-8, the electrical plug 800 (also simply called a plug 800) can include a plug body 822. The plug body 822 can have a shape and size that allows at least a portion of the distal end to be disposed within the cavity 119 of the housing 110 to allow for coupling between the plug 1200 and the electrical receptacle 100. In this case, the cross-sectional shape of the plug body 822 is circular, which matches the cross-sectional shape of the cavity 119 of the housing 100.

Disposed on the end surface 851 at the distal end of the plug body 822 are a number (in this case, three) of terminals 858 that extend outward from the end surface 851. The terminals are made of one or more of a number of electrically conductive materials, including but not limited to copper and aluminum. The shape, size, orientation, and positioning of the terminals 858 are configured to be substantially complementary to the shape, size, orientation, and positioning of terminal receivers that traverse the faceplate 510 as well as the pin assemblies 424 of the outer body 400. This allows the electrical plug 800 to be mechanically and electrically coupled to the electrical receptacle 100. If the shape, size, orientation, and positioning of the terminals 858 are not substantially complementary to the shape, size, orientation, and positioning of the terminal receivers that traverse the faceplate 510 and the pin assemblies 424 of the outer body 400, then the plug 800 cannot be mechanically and electrically coupled to the electrical receptacle 100.

Figure 9A:
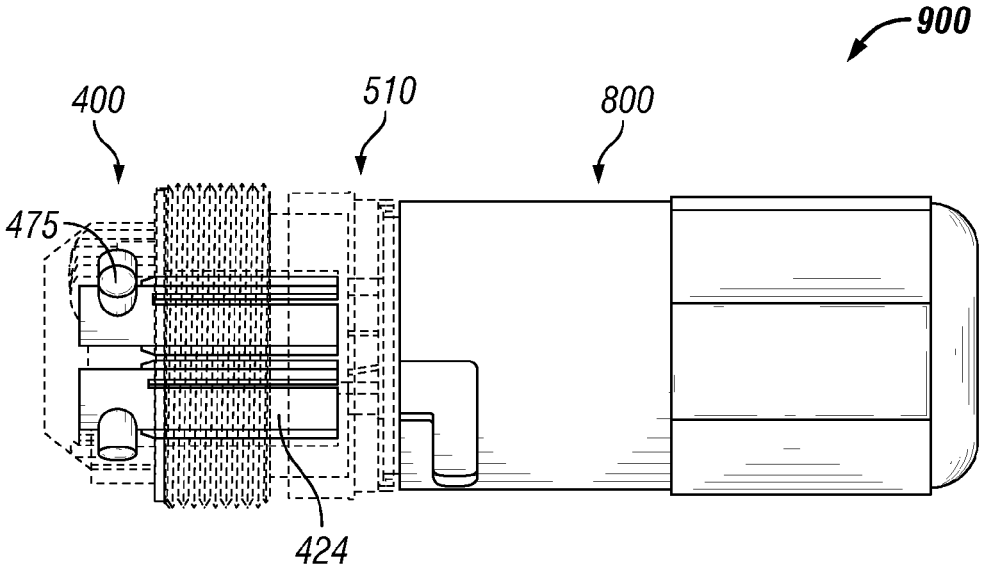
FIGS. 9A-9C show various views of a plug and a portion of the electrical receptacle in accordance with certain example embodiments.
Figure 9B:
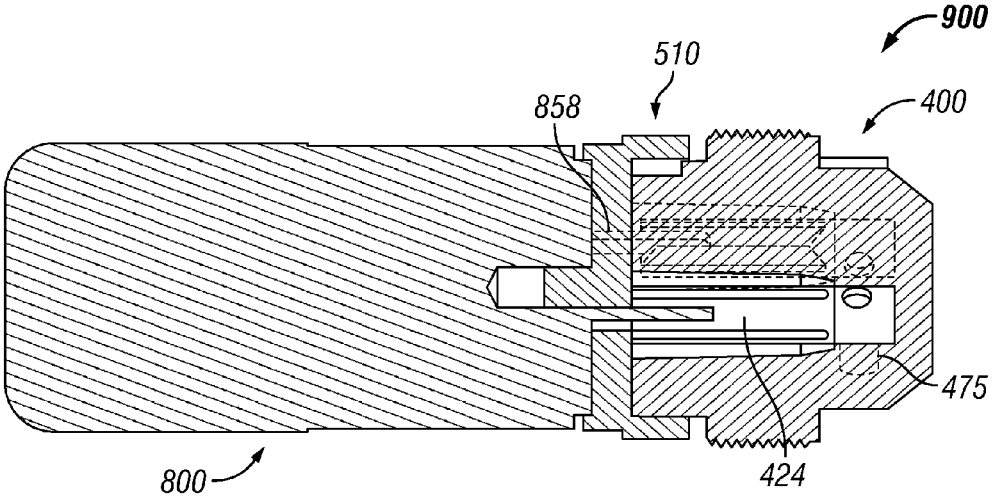
Figure 9C:
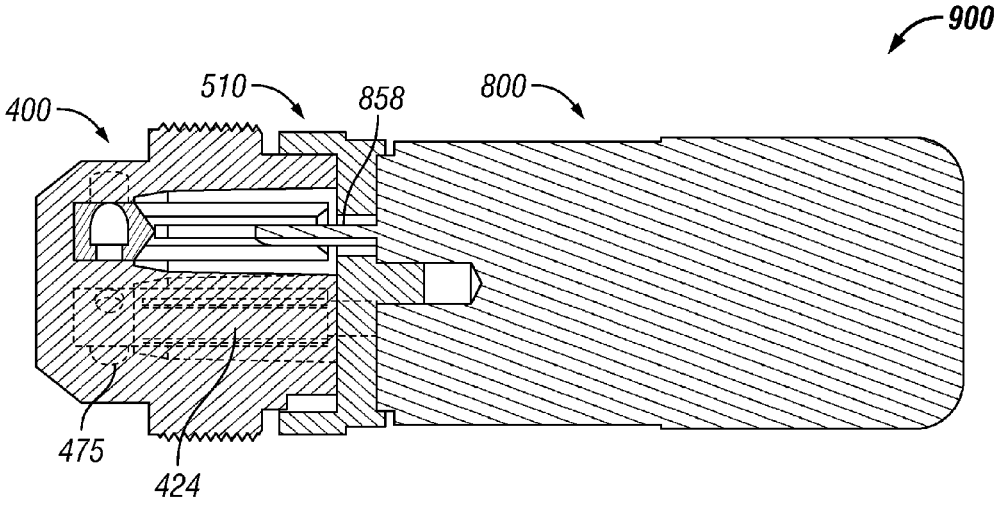

FIGS. 9A-9C show various views of an electrical receptacle subassembly 900 that includes the plug 800, the faceplate 510, and the outer body 400 in accordance with certain example embodiments. Specifically, FIG. 9A shows a side view of the subassembly 900 with the outer body 400 and the faceplate 510 in transparency. FIGS. 9B and 9C each show different cross-sectional side views of the subassembly 900 with the outer body 400 and the faceplate 510 in transparency. In one or more example embodiments, one or more of the components shown in FIGS. 9A-9C may be omitted, repeated, and/or substituted. Accordingly, example embodiments of an electrical plug and electrical receptacle (or portions thereof) should not be considered limited to the specific arrangements of components shown in FIGS. 9A-9C.

Referring to FIGS. 1A-9C, FIGS. 9A-9C show how the terminals 856 of the plug 800 traverse the terminal receivers of the faceplate 510 and are engaged with the pin assemblies 424 of the outer body 400. FIGS. 9A-9C also show how each of the terminals 856 of the plug 800 are disposed within each of the pin assemblies 424 of the outer body 400.

In one or more example embodiments, example contact mechanisms for electrical receptacle assemblies described herein allow for electrical connection between components within an electrical assembly to be achieved safely and securely. Using example embodiments, the electrical coupling and/or decoupling of various components within the electrical receptacle can be unaffected by vibrations and other forces which can create an unintended result as far as the electrical coupling status of those components. Further, example contact mechanisms can comply with one or more of a number of standards and/or regulations for electrical connectors. Such standards and/or regulations can be related to hazardous enclosures, hazardous locations, and explosion-proof enclosures.

Accordingly, many modifications and other embodiments set forth herein will come to mind to one skilled in the art to which contact mechanisms for electrical receptacle assemblies pertain having the benefit of the teachings presented in the foregoing descriptions and the associated drawings. Therefore, it is to be understood that contact mechanisms for electrical receptacle assemblies are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. An electrical receptacle assembly, comprising:

an inner body comprising at least one first wall forming a first cavity and at least one resilient element disposed within the cavity proximate to the at least one first wall, wherein the at least one resilient element comprises an electrically conductive material; and an outer body movably disposed within the first cavity, wherein the outer body comprises at least one extension, at least one home slot, and at least one detent positioned between the at least one extension and the at least one home slot, wherein the at least one extension comprises the electrically conductive material, and wherein the at least one detent and the at least one home slot comprise an electrically non-conductive material, wherein the outer body moves between a first position and a second position, wherein the at least one resilient element contacts the at least one detent when the outer body is between the first position and the second position, and wherein the at least one resilient element contacts the at least one extension when the outer body is in the second position.

2. The electrical receptacle assembly of claim 1, wherein the inner body remains stationary when the outer body moves.

3. The electrical receptacle assembly of claim 1, wherein the at least one resilient element traverses a bottom wall of the inner body and further comprises a first end and a second end, wherein the first end contacts the at least one home slot, the at least one detent, and the at least one extension, and wherein the second end is disposed on a bottom surface of the inner body and is mechanically coupled to a conductor.

4. The electrical receptacle assembly of claim 3, wherein the first end is substantially perpendicular to the second end.

5. The electrical receptacle assembly of claim 3, wherein the at least one resilient element is overmolded into the inner body.

6. The electrical receptacle assembly of claim 3, wherein the second end of the at least one resilient element is coupled to the bottom surface of the inner body using a fastening device.

7. The electrical receptacle assembly of claim 6, wherein the fastening device further secures an electrical conductor.

8. The electrical receptacle assembly of claim 3, wherein the first end of the at least one resilient element comprises a front surface, wherein the front surface contacts the at least one detent when the outer body is between the first position and the second position, and wherein the front surface contacts the at least one extension when the outer body is in the second position.

9. The electrical receptacle assembly of claim 1, wherein the at least one wall of the inner body comprises at least one first recess disposed adjacent to the at least one resilient element, wherein the at least one first recess comprises a first width that is larger than a second width of the at least one resilient element.

10. The electrical receptacle assembly of claim 9, wherein the at least one wall of the inner body further comprises at least one second recess positioned adjacent to the at least one first recess, wherein the at least one second recess has a third width that is larger than the first width of the at least one first recess.

11. The electrical receptacle assembly of claim 10, wherein the outer body further comprises at least one protrusion having a fourth width and disposed adjacent to the at least one home slot and the at least one extension, wherein the at least one protrusion is positioned within the at least one second recess of the inner body, wherein the fourth width is less than the third width, wherein the at least one second recess of the inner body limits movement of the outer body between the first position and the second position.

12. The electrical receptacle assembly of claim 1, wherein the at least one detent prevents the outer body from moving out of the second position when vibrations are present.

13. The electrical receptacle assembly of claim 1, wherein the bottom wall of the inner body, the at least one first wall of the inner body, and bottom portion of the outer body forms an explosion-proof enclosure.

14. The electrical receptacle assembly of claim 13, wherein the at least one first wall of the inner body and the bottom portion of the outer body are separated by a first gap when the outer body is in the first position, wherein the at least one first wall of the inner body and the bottom portion of the outer body are separated by a second gap when the outer body is in the second position, and wherein the first gap is larger than the second gap.

15. The electrical receptacle assembly of claim 1, further comprising:

a housing comprising at least one second wall that forms a second cavity and at least one first coupling feature disposed on an inner surface of the at least one second wall, wherein the outer body further comprises a second coupling feature disposed on a first outer surface of the outer body, wherein the first coupling feature and the second coupling feature allow the outer body to move between the first position and the second position.

16. The electrical receptacle assembly of claim 15, wherein the first coupling feature and the second coupling feature are mating threads.

17. The electrical receptacle assembly of claim 15, wherein the inner body further comprises a third coupling feature disposed on a second outer surface of the inner body, wherein the housing further comprises a fourth coupling feature disposed on the inner surface of the at least one second wall, wherein the third coupling feature and the fourth coupling feature maintain the inner body in a stationary position.

18. The electrical receptacle assembly of claim 15, wherein the housing is configured to mechanically couple to an electrical enclosure located in a potentially hazardous environment.

19. The electrical receptacle assembly of claim 1, wherein the at least one extension is electrically and mechanically coupled to at least one pin assembly that traverses the outer body, wherein the at least one pin assembly carries electrical power between the at least one resilient element and an electrical plug.

20. The electrical receptacle assembly of claim 1, wherein the inner body and the outer body comprise an electrically non-conductive material.

* * * * *